US006159289A

United States Patent [19]

Kurtz et al.

[11] Patent Number: 6,159,289

[45] Date of Patent: Dec. 12, 2000

[54] DOCTORING DEVICE FOR AN APPARATUS TO APPLY A LIQUID OR VISCID MEDIUM ONTO A MOVING BASE SURFACE

[75] Inventors: Rüdiger Kurtz, Heidenheim; Harald Hess, Grünkraut; Christoph Henninger, Heidenheim, all of Germany

[73] Assignee: Voith Sulzer Papiertechnik Patent GmbH, Heidenheim, Germany

[21] Appl. No.: 09/163,690

[22] Filed: Sep. 30, 1998

[30] Foreign Application Priority Data

Oct. 1, 1997 [DE] Germany ..... 197 43 520

[51] Int. Cl.[7] ..... B05C 11/02

[52] U.S. Cl. ..... 118/119; 118/122; 118/126; 118/413

[58] Field of Search ..... 118/117, 118, 118/119, 121, 122, 123, 413, 126; 427/359

[56] References Cited

U.S. PATENT DOCUMENTS

| | | | |
|---|---|---|---|
| 4,169,425 | 10/1979 | Wohrle | 118/665 |
| 4,178,015 | 12/1979 | Merriman et al. | 280/683 |
| 4,245,582 | 1/1981 | Alheid et al. | 118/119 |
| 5,383,968 | 1/1995 | Rantanen et al. | 118/119 |
| 5,599,392 | 2/1997 | Liang et al. | 118/110 |

FOREIGN PATENT DOCUMENTS

| | | |
|---|---|---|
| 42 09 566 A1 | 9/1992 | Germany . |
| 43 41 341 C1 | 3/1995 | Germany . |
| 196 02 483 C1 | 6/1997 | Germany . |
| 196 19 250 A1 | 11/1997 | Germany . |

*Primary Examiner*—Laura Edwards
*Attorney, Agent, or Firm*—Taylor & Aust, P.C.

[57] ABSTRACT

A doctoring device for an apparatus designed to apply a liquid or viscid medium onto a moving base surface includes a metering unit having a coater rod and a coater rod bed. The metering unit is attached to the support beam and is positioned so that it can be pressed against the base surface. A pressure-elastic support arrangement is disposed between the coater beam and the coater rod bed. The coater rod bed is supported pressure-elastically by the support beam via the support arrangement in at least two support directions that are perpendicular to each other. The spring rate of the support arrangement is adjustable in at least one of the support directions. A preferred support arrangement includes pressure hoses which are assigned to each of the two support directions. The pressures in these hoses can be adjusted, independently from each other, to a pre-determined level via a pressure source. Unwanted deformation of the support beam in various directions relative to the base surface can thereby be compensated for. Furthermore, there is a large degree of freedom in the selection of the mounting position of the doctoring device relative to the base surface.

17 Claims, 2 Drawing Sheets

DOCTORING DEVICE FOR AN APPARATUS TO APPLY A LIQUID OR VISCID MEDIUM ONTO A MOVING BASE SURFACE

BACKGROUND OF THE INVENTION

1. Field of the Invention

The present invention relates to a doctoring device for an apparatus designed to apply a liquid or viscid medium onto a moving base surface.

2. Description of the Related Art

A doctoring device for a coating applicator is, for example, known from German patent document no. DE 42 09 566 A 1. In typical designs, the coater rod bed, per FIG. 6 of DE 42 09 566 A 1, includes a blade-like coater rail which is positioned in an opening in the coater beam. In this opening, the coater rail is embedded on a pressure-elastic cushion which provides an elastic support structure for the coater rail tangentially to the base surface. Furthermore, the opening in the coater beam also bears a pressure hose which supports the coater rail directionally perpendicular to the base surface. The pressure in this hose can be controlled so that the spring rate of the pressure hose can be adjusted.

Principally, it is desired to apply a coating of the liquid or viscid medium onto the base surface as uniformly as possible. This applies to the longitudinal direction as well as the transverse direction of the base surface. Especially in the transverse direction, the coating quality is adversely impacted by gravity or thermally-related deformation of the coater beam.

Insofar as these deformations only occur in a direction perpendicular to the base surface, the well-known design configuration shown on German patent document no. DE 42 09 566 A 1 provides an effective remedy. The ability to control the pressure in the pressure hose provides an optimum tuning of the spring rate to match the degree of deformation and, thus, the desired contact pressures between the coater rail and the base surface. It has been shown, however, that deformations that occur during operation of the coater apparatus not only develop in a direction perpendicular to the base surface, but also in other directions. The pressure-elastic cushion, per the design shown in German patent document no. DE 42 09 566 A1, provides inadequate remedy to overcome this problem. Due to this problem, local non-uniform pressure conditions can develop between the coater rail and the base surface in the transverse direction of the base surface. This results in a non-uniform coating profile.

SUMMARY OF THE INVENTION

The present invention provides a doctoring device that has design features that result in a uniform coating profile, even when complex deformation conditions are present. The doctoring device of the present invention includes a coater rod bed which is attached to a coater beam and is positioned so that it can be pressed against a base surface. Further, the doctoring device includes a pressure-elastic support arrangement between the support beam and the coater rod bed through which the coater rod bed is supported pressure-elastically by the support beam in at least two support directions that are perpendicular to each other. Thus, the spring rate of the support arrangement is adjustable in at least one of the support directions. The present invention addresses the above-mentioned problem by providing the capability of adjusting the spring rates of the support arrangement independently from each other in at least two directions. Through this solution, which is captured by the spirit and scope of the invention, a second degree of freedom is made available in adjusting the spring rate of the support arrangement. In this way, different deformations of the support beam, and even deformations of the base surface, can be compensated for. This compensation provides optimum pressure conditions between the coater rod and the base surface. The doctoring device, according to this invention, is not bound to a fixed mounting position. Rather, the doctoring device can essentially be mounted in any orientation relative to the base surface, since the optimum pressure conditions between the coater rod and the base surface can consistently be achieved by adjusting the spring rate of the support arrangement in the various support directions. The base surface is understood to be in the form of an applicator roll in the case of indirect application, and the base surface is understood to be a material web such as paper, cardboard, or carton in the case of direct application.

A targeted profile of the coating in the transverse direction is made possible by the support arrangement whose spring rate can be varied in at least one of the support directions along the width of the base surface and perpendicular to its movement. A transverse profiling of the coating not only smooths a non-uniform or wave like profile by appropriate variation of the spring rate, but also enables a deliberate non-uniform transverse profile of the coating by applying, for example, a thinner layer of medium along the edges of the base surface.

The support arrangement can be adjusted in any support direction with respect to its spring rate. It is possible, for example, that one support direction and its associated spring rate are nearly perpendicular to the base surface in the contact area formed between the coater rod bed and the base surface. It is also possible that one support direction and its associated spring rate are nearly tangential to the base surface in the contact area formed between the coater rod bed and the base surface. Likewise, it is further possible that one support direction and its adjustable spring rate includes an acute angle relative to the base surface in the contact area formed between the coater rod bed and the base surface. Two support directions and their adjustable spring rates should be aligned perpendicular to each other. It is understood, however, that two support directions and their adjustable spring rates can also be aligned at an acute or an obtuse angle relative to each other. In a preferred design configuration, the support arrangement includes a support hose arrangement which is connected to a pneumatic pressure source and has at least one support hose.

The support hose includes at least one innertube which is supplied by a pressure source that is used for the adjustment and maintenance of a predetermined pressure in the inner tube. Such a support hose can compensate for deformation of the support beam without significantly changing the pressure force between the coater rod and the base surface. The spring rate of the support hose can thus be easily adjusted by increasing or decreasing the pressure in the inner tube. For practical reasons, each of the two support directions is assigned at least one support hose. A pressure supply is used to provide and maintain the pressure in each of the innertubes of the support hoses, independent from each other. Not excluded within the scope of this invention are other pressure-elastic support components such as, for example, a piston-cylinder assembly that can effectively function as pressure-elastic member between the coater beam and the coater rod bed. Of course, support components whose spring rate can be adjusted can be combined with support components whose spring rate cannot be adjusted.

The innertube can be a continuous unit along the width of the base surface, with the innertube extending perpendicular to the movement of the base surface. The pressure in the inner tube is then constant across the entire width of the base surface, which subsequently results in uniform pressure distribution between the coater rod and the base surface along its entire width, as long as there are no other devices affecting the transverse profile. However, a targeted transverse profile of the coating thickness of the medium that is to be applied can be achieved with the help of a support arrangement whose support hose, which runs across the width of the base surface and perpendicular to its movement, includes several innertubes which are independent from each other. Each innertube is independently supplied by a pressure source that provides and maintains the pressure in each of the innertubes. By adjusting the pressures in the individual innertubes, it is possible to achieve a targeted pressure distribution between the coater rod and the base surface. In both cases, i.e., a single innertube or several innertubes that are separated from each other, a longitudinal profiling is made possible by varying the pressure of the inner tube or innertubes, depending on the quantified coating thickness of a preceding portion of the base surface.

For a transverse profiling of the coating thickness of the medium that is to be applied onto the base surface, there are other mechanical transverse profiling devices that act directly upon the coater rod bed and/or the support beam. Such devices can be adjusting screws which can provide a targeted deformation of the coater rod bed and/or support beam, which deformation is reflected by locally different contact pressures between the coater rod bed and the base surface.

Not excluded within the scope of this invention is a coater rod bed made of a coater blade or coater rail. Indeed, a preferred coater rod bed design supports a coater rod that is free to turn, wherein the coater rod bed is mounted on an elongated coater beam via a leaf spring arrangement.

According to this invention, the doctoring device is suitable for pre-dispensing as well as for post-dispensing the medium that is to be applied onto the base surface. For pre-dispensing, the doctoring device is employed in the immediate area where the medium is distributed, whereby the coater rod bed is an application unit which does a rather coarse job of dispensing the medium. For the post-dispensing, the doctoring device is employed at a distance from the area where the medium is being distributed. Thus, the doctoring device performs a final fine-dispensing of a medium that has already been pre-dispensed. Further, the doctoring device of the present invention can be utilized to clean the applicator roll, such as by removing paint residues and dirt particles from the applicator roll.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
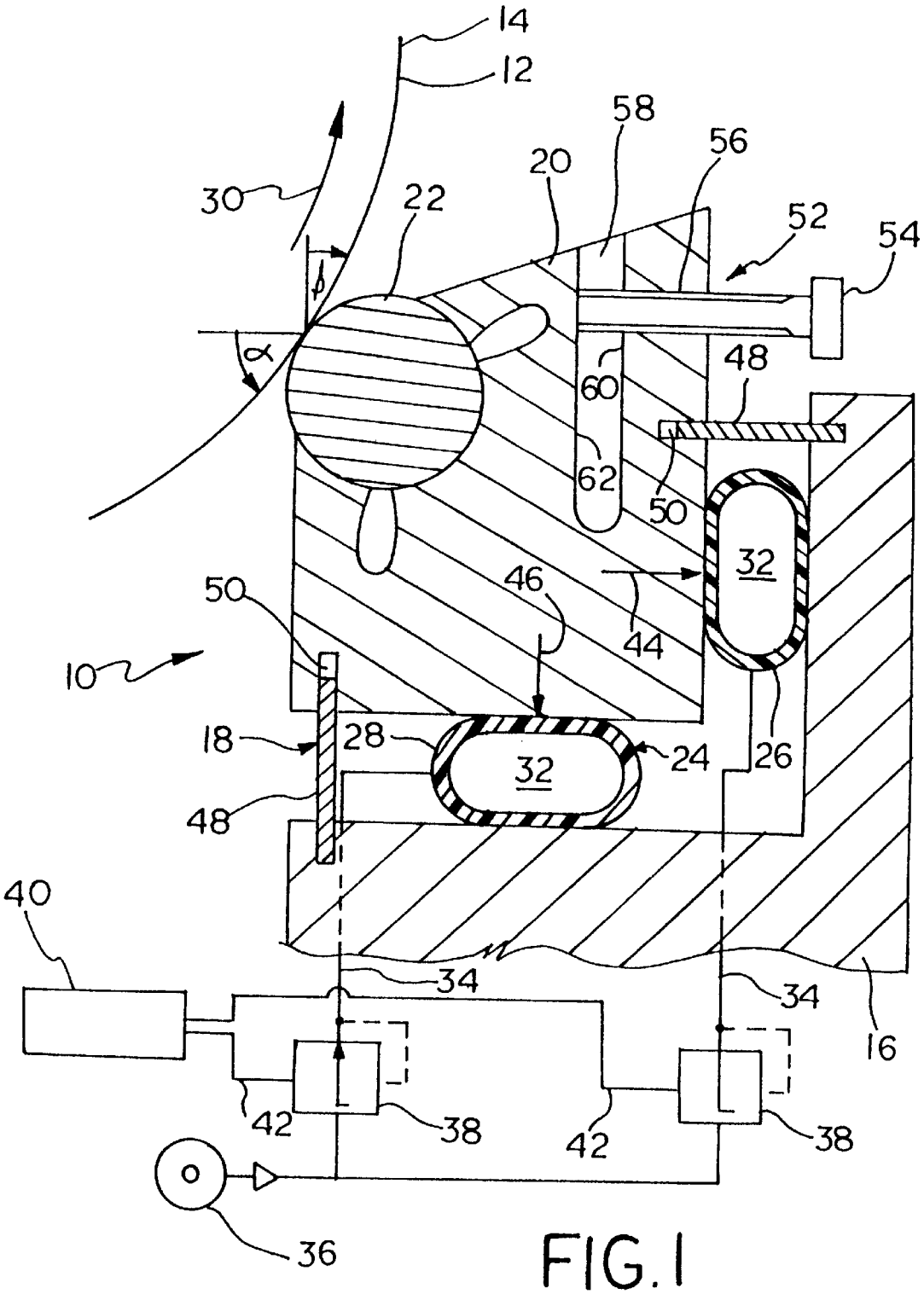
FIG. 1 a schematic, cross-sectional view of one embodiment of a doctoring device of the present invention.

Referring now to the drawings and particularly to FIG. 1, there is shown a doctoring device 10 of the present invention. Doctoring device 10 is part of an applicator mechanism and serves to apply a uniform coating of a liquid or viscid coating medium onto a base surface 12 which is moving past the doctoring device 10. Base surface 12 is formed by the circumferential surface area of an applicator roll 14 which serves to directly apply the coating medium onto a material web (not shown) made of paper, cardboard or carton. The material web runs, in this case, across a support roll (not shown) which is partially surrounded by the material web.

The doctoring device 10 distributes the medium that is being applied onto the base surface 12 and scrapes, if necessary, surplus coating material off of the base surface 12. Doctoring device 10 includes an elongated coater beam 16 onto which a coater rod bed 20, bearing a freely-turning coater rod 22, is mounted by use of a leaf spring arrangement 18. Between the coater beam 16 and the coater rod bed 20 resides a pressure-elastic support arrangement 24 through which the coater rod bed 20 is supported pressure-elastically by the coater beam 16. The support arrangement 24 exerts a force onto the coater rod bed 20 which, in turn, leads to the coater rod 22 exerting a pressure force onto the base surface 12. Moreover, the support arrangement 24 compensates for inaccuracies in the straightness of the coater beam 16 as well as the base surface 12. Support arrange 24 includes two pneumatic hoses 26, 28 which run across the entire width of the base surface 12, perpendicular to the direction of the movement of the base surface 12 as indicated in FIG. 1 by arrow 30. Both pneumatic hoses 26, 28 have at least one innertube 32 which can extend across the entire width of the base surface 12 as a single unit, or innertube 32 can be formed by several innertubes which are arranged sequentially across the width of the base surface 12.

The innertubes 32 of the pneumatic hoses 26, 28 are connected to a pneumatic pressure source 36 via the pneumatic lines 34. In each of the pneumatic lines 34, there is a pressure regulator valve 38 attached. Pressure regulator valve 38 serves to equalize possible pressure variations of the pneumatic pressure source 36 and allows for a constant air pressure to the innertube 32 of the respective pneumatic hoses 26 and 28. The air pressure emitted at the outlet of the pressure regulator valves 38 can be adjusted, for example, with a microprocessor 40 via control lines 42. The control of the pressure regulator valves 38 via the control lines 42 can, for example, be performed pneumatically or electrically. Different pressure levels, which are independent from each other, can be applied to the pressure regulator valves 38 via the control lines 42 so that the pneumatic hoses 26, 28 can be set to different pressures.

If one or both of the pneumatic hoses 26, 28 are segmented, i.e., there are several separate innertubes 32 along the width of the base surface 12, then each of the innertube segments is connected to its own pneumatic line 34 so that each of the respective innertubes can receive a predetermined pressure independent from the other innertube segments. In this way, an uneven spring rate of the respective pneumatic hose 26, 28 can be achieved along the width of the base surface 12. It is to be understood that the pressure adjustment in the pneumatic hoses 26, 28 can be performed by control unit 40, via control of the pressure to the pressure regulator valves 38, as part of a control logic which uses quantified product features of a final or pre-final product which is coated with the application medium. The stated product features usually include parameters such as coating thickness of the medium, which may be staining color or glutinous matter, that is to be applied onto the material web. These measurements can be taken with the aid of optical sensors, for example.

The two pneumatic hoses 26, 28 of the support arrangement 24 are arranged such that the coater bed 20 is supported on the coater beam 16 in two mutually perpendicular support directions. The support direction that is assigned to pneumatic hose 26 is indicated by arrow 44 in FIG. 1. The support direction that is assigned to pneumatic hose 28 is indicated by arrow 46. In the contact area formed between the coater rod 22 and the base surface 12, the support directions 44, 46 form an acute angle relative to the base surface 12. For the support direction 44, the acute angle is designated with $\alpha$, while for the support direction 46, the acute angle is designated as $\beta$. In the schematic depiction of FIG. 1, the angles $\alpha$, $\beta$ are not identical. It is to be understood, however, that the angles $\alpha$,$\beta$ can be the same. This depends fundamentally upon the mounting position of the doctoring device 10 relative to the base surface 12.

A fundamental advantage of the doctoring device 10, according to this invention, is the flexibility of the mounting position of the doctoring device 10 relative to the base surface 12. Because of the capability of appropriately adjusting the pressures in the pneumatic hoses 26, 28, the doctoring device 10 can be mounted in any position at a desired contact pressure and at a desired angle relative to the base surface 12. The example of a mounting position as illustrated in FIG. 1 shows the weight of the coater rod bed 20 and coater rod 22 being transferred to the coater beam 16 solely via the pneumatic hose 28. The effective contact force between the coater rod 22 and the base surface 12 is largely generated by the pneumatic hose 26 due to the larger angle $\alpha$. Accordingly, the pressure setting in the pneumatic hose 28 and, consequently, the spring rate of the support arrangement 24 in support direction 46 should favor the support of the weight of the coater rod bed 20 and the coater rod 22. The pressure setting of the pneumatic hose 26 and, consequently, the spring rate of the support arrangement 24 in support direction 44 should favor the achievement of the desired contact force. In a different mounting position, these relationships can be completely different.

The leaf spring arrangement 18 fundamentally provides a torsional retention for the coater rod bed 20 so that, during rotation of the applicator roll 14 in direction of rotation 30, the coater rod bed 20 is not excessively torsionally deformed with respect to the coater beam 16, given the level of spring rate provided by the support arrangement 24. The torsional moments imposed on the coater rod bed 20 are transferred via the leaf spring arrangement 18 to the coater beam 16. The leaf spring arrangement 18 includes, as illustrated in the example FIG. 1, two leaf springs 48 which are solidly mounted on the coater beam 16 and loosely fitted to the coater rod bed 20 as indicated by 50. The loose fit of the leaf spring 48 eases the pressure-elastic movement of the coater rod bed 20 relative to the coater beam 16 in the support directions 44, 46.

An additional transverse profiling mechanism 52 may be appropriate, with which a targeted transverse profiling of the coating thickness of the medium that is to be applied can be achieved. Such a mechanism is especially appropriate when the innertubes 32 of the pneumatic hoses 26, 28 extend along the entire width of the base surface 12 and, consequently, no transverse profiling along the width of the base surface 12 as a result of pressure variation is possible. As shown in the design example in FIG. 1, the transverse profiling mechanism 52 includes several adjusting screws 54 that are distributed along the width of the base surface 12. Each screw 54 is screwed into a threaded hole 56 in the coater rod bed 20. The coater rod bed 20 includes a machined slot 58 that extends along the width of the base surface 12. One side surface 60 of this slot 58 intersects with the threaded holes 56 so that the adjusting screws 54 bottom out against the opposite slot side surface 62. Through tightening of the adjusting screws 54, the slot 58 can be widened, which leads to a local expansion of the coater rod bed 20. This expansion effectively increases the contact force between the coater rod 22 and the base surface 12 without having to change the pressures in the pneumatic hoses 26, 28. By appropriate tightening or loosening of the adjusting screws 54 along the width of the base surface 12, a desired transverse profile of the coating thickness of the medium that is to be applied can be achieved.

Figure 2:
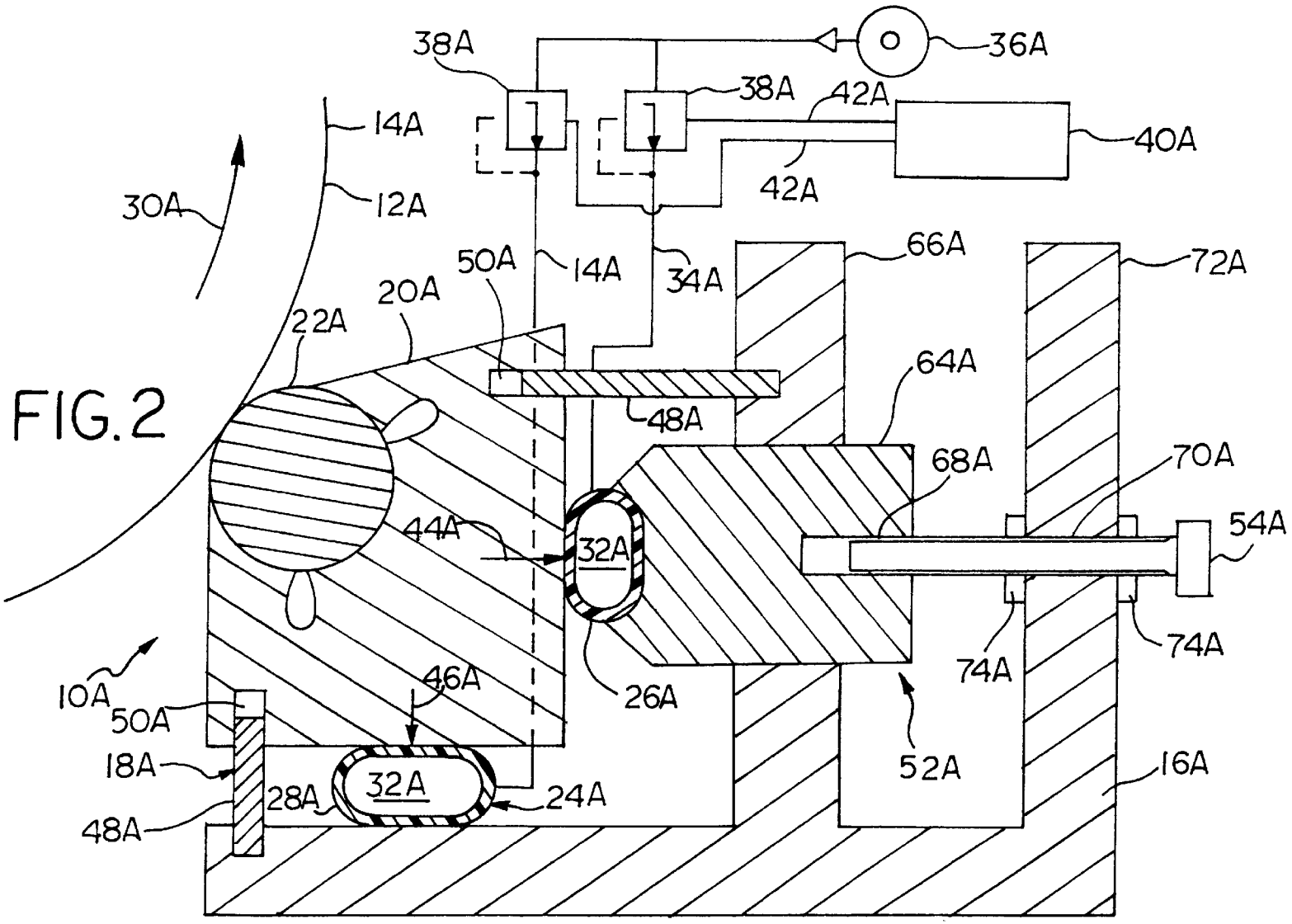
FIG. 2 a schematic, cross-sectional view of another embodiment of a doctoring device of the present invention.

FIG. 2 depicts the same or similar components as in FIG. 1 using the same number designation; however, the lower case "a" has been added. The design configuration per FIG. 2 fundamentally differs from the design configuration depicted in FIG. 1 only in a different design of the transverse profiling mechanism 52*a*, which is the focal point of the following text. For the rest, the description of FIG. 1 applies.

In FIG. 2, a slide unit 64*a* is assigned to pneumatic hose 26*a*, which is supported in a moveable fashion in cross piece 66*a* of the coater beam 16*a* in support direction 44*a*. The slide unit 64*a* has a threaded hole 68*a* on its side that is opposite to the surface that contacts the pneumatic hose 26*a*. The adjusting screw 54*a* is engaged into threaded hole 68*a*. The adjusting screw 54*a* is inserted into a through-hole 70*a* of an additional cross piece 72*a*, which is arranged adjacent to cross piece 66*a*. Both cross pieces 66*a* and 72*a* are part of the coater beam 16*a*. Adjusting screw 54*a* can be locked into its position with respect to cross piece 72*a* by use of two threaded nuts 74*a*. Through loosening of the nuts 74*a*, the adjusting screw 54*a* can be activated in order to move the slide unit 64*a* to the desired position relative to the coater rod bed 20*a*. It is to be understood that there are several slide units 64*a* distributed along the width of the base surface 12*a* that are adjustable with one or more adjusting screws 54*a*. In this way, the coater beam 16*a* can be locally expanded or contracted. This local expansion or contraction corresponds to an appropriate local change in the contact force between the coater rod 22*a* and the base surface 12*a*.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A doctoring device for an apparatus configured for applying a coating medium onto a moving base surface having a width and a direction of movement, said doctoring device comprising:

a metering unit including a coater rod and a coater rod bed carrying said coater rod, said metering unit being configured for being pressed against the base surface at a contact area;

a support beam attached to said coater rod bed; and a pressure-elastic support arrangement disposed between said support beam and said coater rod bed, said pressure-elastic support arrangement being supported by said support beam in at least two support directions, said support directions being perpendicular to each other, each said support direction being away from an imaginary line tangent to the base surface at the contact area, said pressure-elastic support arrangement exerting at least two forces upon said coater rod bed, each said force being independently adjustable in a respective one of said at least two support directions.

2. The doctoring device of claim 1, wherein at least one said force is independently adjustable substantially across the width of the base surface and in a direction substantially perpendicular to the direction of movement of the base surface.

3. The doctoring device of claim 1, wherein at least one said force is independently adjustable in a direction substantially perpendicular to the base surface in said contact area.

4. The doctoring device of claim 1, wherein at least one said force is independently adjustable in a direction substantially tangential to the base surface in said contact area.

5. The doctoring device of claim 1, wherein at least one said force is independently adjustable in an acute direction, said acute direction being at an acute angle relative to the base surface in said contact area.

6. The doctoring device of claim 1, wherein said at least two forces comprises two forces, each said force being independently adjustable in a respective said support direction, said respective support directions being substantially perpendicular to each other.

7. The doctoring device of claim 1, wherein said pressure-elastic support a support hose arrangement having at least one support hose with at least one inner tube, said at least one innertube having a predetermined internal pressure; and a pneumatic pressure source in fluid communication with said at least one inner tube, said pressure source being configured for adjustment and maintenance of said predetermined internal pressure of said at least one inner tube.

8. The doctoring device of claim 7, wherein each said support direction is associated with said pressure source and with at least one respective said support hose, said at least one innertube comprising a plurality of innertubes, said pressure source being configured for providing and maintaining independent pressure in each said innertube of each said support hose.

9. The doctoring device of claim 7, wherein said at least one innertube comprises an innertube that is continuous substantially across the width of the base surface, said innertube being oriented substantially perpendicular to the direction of movement of the base surface.

10. The doctoring device of claim 7, wherein said at least one support hose comprises a plurality of separate inner tubes, each said innertube having a respective said predetermined internal pressure, said inner tubes extending substantially across the width of the base surface, each said innertube being oriented substantially perpendicular to the direction of movement of the base surface, each said innertube being in independent fluid communication with said pressure source, said pressure source being configured for adjustment and maintenance of each said predetermined internal pressure of each said inner tube.

11. The doctoring device of claim 1, wherein, from any point separated from the base surface by the imaginary line, each said support direction is away from the imaginary line.

12. The doctoring device of claim 1, wherein said support beam is fixed relative to the base surface.

13. The doctoring device of claim 1, wherein said support beam has a first portion attached to said coater bed, said pressure-elastic support arrangement being supported by a second portion of said support beam, said second portion being fixed relative to said first portion.

14. The doctoring device of claim 1, further comprising a leaf spring arrangement interconnecting said support beam and said coater rod bed.

15. A doctoring device for an apparatus configured for applying a coating medium onto a moving base surface having a width and a direction of movement, said doctoring device comprising:

a metering unit including a coater rod and a coater rod bed carrying said coater rod, said metering unit being configured for being pressed against the base surface at a contact area;

a support beam attached to said coater rod bed;

a pressure-elastic support arrangement disposed between said support beam and said coater rod bed, said pressure-elastic support arrangement being supported by said support beam in at least two support directions, said support directions being perpendicular to each other, said pressure-elastic support arrangement exerting at least two forces upon said coater rod bed, each said force being independently adjustable in a respective one of said at least two support directions; and a transverse profiling mechanism configured for profiling a thickness of the coating medium on the base surface, said profiling being in a direction substantially perpendicular to the direction of movement of the base surface, said transverse profiling mechanism directly engaging said metering unit.

16. The doctoring device of claim 15, wherein said transverse profiling mechanism includes at least one adjusting screw directly engaging said metering unit.

17. A doctoring device for an apparatus configured for applying a coating medium onto a moving base surface having a width and a direction of movement, said doctoring device comprising:

a metering unit including a coater rod and a coater rod bed carrying said coater rod, said metering unit being configured for being pressed against the base surface at a contact area;

a support beam attached to said coater rod bed;

a pressure-elastic support arrangement disposed between said support beam and said coater rod bed, said pressure-elastic support arrangement being supported by said support beam in at least two support directions, said support directions being perpendicular to each other, said pressure-elastic support arrangement exerting at least two forces upon said coater rod bed, each said force being independently adjustable in a respective one of said at least two support directions; and a leaf spring arrangement interconnecting said support beam and said coater rod bed, said support beam being elongated, said coater rod being rotatingly carried by said coater rod bed.

* * * * *

UNITED STATES PATENT AND TRADEMARK OFFICE

CERTIFICATE OF CORRECTION

PATENT NO. : 6,159,289

DATED : December 12, 2000

INVENTOR(S) : Rudiger Kurtz et al.

It is certified that error appears in the above-identified patent and that said Letters Patent is hereby corrected as shown below:

Column 2

Line 24, delete "wave like" and substitute --wavelike--therefor.
Line 51, delete "inner tube" and substitute --innertube-- therefor.
Line 56, delete "inner tube" and substitute --innertube-- therefor.

Column 3

Line 4, delete "inner tube" and substitute --innertube-- therefor.

Column 4

Line 33, delete "arrange" and substitute --arrangement-- therefor.

Column 7

Line 35, after "support" insert--arrangement includes:-- therefor.
Line 37, delete "inner tube" and substitute --innertube-- therefor.
Line 41, delete "inner tube" and substitute --innertube-- therefor.
Line 44, delete "inner tube" and substitute --innertube-- therefor.
Line 67, delete "inner tube" and substitute --innertube-- therefor.

Signed and Sealed this

First Day of May, 2001

*Attest:*

Nicholas P. Godici

NICHOLAS P. GODICI

*Attesting Officer*

*Acting Director of the United States Patent and Trademark Office*